United States Patent [19]

Byrne

[11] 4,172,721

[45] Oct. 30, 1979

[54] DYE-AMPLIFIED IMAGING PROCESS

[75] Inventor: John F. Byrne, Worthington, Ohio

[73] Assignee: Xerox Corporation, Stamford, Conn.

[21] Appl. No.: 783,871

[22] Filed: Apr. 1, 1977

Related U.S. Application Data

[63] Continuation-in-part of Ser. No. 706,977, Jul. 19, 1976, abandoned, which is a continuation of Ser. No. 512,802, Oct. 4, 1974, abandoned, which is a continuation-in-part of Ser. No. 418,491, Nov. 23, 1973, abandoned.

[51] Int. Cl.[2] ..... G03G 13/01; G03G 17/04

[52] U.S. Cl. ..... 96/1.2; 96/1 PE; 96/1 M; 96/1 PS

[58] Field of Search ..... 96/1 PE, 1 M, 1 PS, 96/1.2, 1.3

[56] References Cited

U.S. PATENT DOCUMENTS

| | | | |
|---|---|---|---|
| 2,940,847 | 6/1960 | Kaprelim | 96/1.2 |
| 3,384,488 | 5/1968 | Tulagin et al. | 96/1.5 X |
| 3,681,064 | 8/1972 | Yeh | 96/1 PE |
| 3,798,030 | 3/1974 | Gundlach | 96/1 PS |
| 3,849,132 | 11/1974 | Wells et al. | 96/1 PE X |
| 3,853,555 | 12/1974 | Reinis et al. | 96/1.2 |
| 3,900,318 | 8/1975 | Zographos et al. | 96/1 PE X |
| 3,912,505 | 10/1975 | Goffe et al. | 96/1.2 |
| 4,012,250 | 3/1977 | Goffe | 96/1 PS |

*Primary Examiner*—Roland E. Martin, Jr.

[57] ABSTRACT

A color separation imaging process employing an imaging monolayer of particles comprising a resin carrier containing color-photosensitive material, and a solid-form dye material. The monolayer is exposed between two members, one transparent, under the influence of an electric field. A color separation image is formed upon splitting the sandwich, and the image is then subjected to thermal energy in order to imbibe the dye into a suitable substrate, thus producing a brilliantly-amplified color image.

15 Claims, 5 Drawing Figures

DYE-AMPLIFIED IMAGING PROCESS

This application is a continuation-in-part of my copending application, Ser. No. 706,977, filed July 19, 1976, now abandoned, which in turn is a continuation of Ser. No. 512,802, filed Oct. 4, 1974, now abandoned, which is a continuation-in-part application of Ser. No. 418,491, filed on Nov. 23, 1973, now abandoned.

BACKGROUND OF THE INVENTION

This invention relates in general to imaging and more specifically, to a process of producing multicolor images utilizing color particles having a resin carrier containing electrically photosensitive material.

In one embodiment of the monochromatic manifold imaging system, an imageable member is prepared by coating a layer of cohesively weak photoresponsive imaging material onto a substrate. This coated substrate is called the "donor." In preparation for the imaging operation, the imaging layer is activated, as by treating it with a swelling agent or partial solvent for the material. This step may be eliminated, of course, if the layer retains sufficient residual solvent after having been coated on the substrate from a solution or paste. The activating step provides the dual function of making the top surface of the imaging layer slightly tacky and, at the same time, weakening it structurally so that it can be fractured more easily along a sharp line which defines the image to be reproduced. Once the imaging layer is activated, a receiving sheet is laid down over its surface. An electrical potential is then applied across this manifold set while it is exposed to a pattern of light-and-shadow representative of the image to be reproduced. Upon separation of the donor substrate and receiving sheet, the imaging layer fractures along the lines defined by the pattern of light-and-shadow to which it has been exposed, with part of this layer being transferred to the receiving sheet while the remainder is retained on the donor sheet. Thus, a positive image is generally produced on one while a negative is produced on the other.

The system is capable of producing monochromatic images of excellent density and resolution. If an attempt is made to uniformly mix pigment particles responding to different colors throughout the imaging material, effective strip-out may not be entirely satisfactory since particles of different colors scattered throughout the thickness of the imaging layer may tend to mask each other and prevent stripping of single colors only in desired single colored areas.

To achieve color spearation in a single set imaging system, U.S. Pat. No. 3,556,783, based on a subtractive color system, provides an imaging set in which the imaging material is coated onto the donor substrate as a plurality of small contiguous areas, different areas having at least two different colors which respond to lights of different colors whereby the manifold set will respond to color originals selectively so as to produce a full-color image corresponding to the original. More specifically, the plurality of small contiguous areas is provided by suitable printing methods such as gravure roller, spraying through stencils, and by conventional color lithography. In all of these techniques an ordered arrangement of colors results.

While multicolored images may be produced in the single set system outlined in U.S. Pat. No. 3,556,783, complete color separation remains a continuing problem due to the fracturable nature of the contiguous areas in the imaging layer as well as the difficulty of attaining perfect registration of the colors. In addition, the ordered array of colors in this system may result in the formation of a moire pattern when imaging a halftone photograph or print. The problem of successive halftone imaging is fully detailed in the text entitled "The Printing Industry," Strauss, P. 193–194, published by The Printing Industries of America, Inc. And further, maximum color density could not be attained in the patented system because of the patterned arrangement of the contiguous colors.

A solution to these difficulties is offered in U.S. Pat. No. 3,854,943, where a subtractive imaging mono-layer, sandwiched between donor and receiver members, is comprised of a plurality of randomly mixed agglomerates of at least two different colors which respond selectively to light. The randomly mixed agglomerates respond in an electric field to radiation within their sensitivities by selectively adhering to the receiver during sandwhich separation whereupon each individual agglomerate is easily and independently removed from the imaging layer. While images resulting from this system demonstrate excellent color separation, it is largely confined to the use of pigment agglomerates. The nature of the colors in such a system depends entirely on the brilliancy of the individual pigments. Such systems generally result in low color saturation because of the particulate nature of the color entities. This instant invention attains high color saturation by the use of dyes rather than pigments.

In U.S. Pat. No. 2,940,847 to Kaprelian there is described, among other things, a particle imaging system in which multi-layered particles of dye-filtered photoconductor on a resin core material as utilized, optionally containing a central liquid dye core. However, the imaging layer of this system is three or more particles deep which magnitude results in obvious color separation difficulties. Furthermore, the dyes used in this system are encapsulated for ultimate pressure release onto a suitable absorbent substrate. The use of pressure sensitive capsules in imaging systems is generally undesirable because of the problems in preparation of the imaging particles as well as inconsistency in pressure bursting of the liquid dye particles in obtaining a final image.

In yet another patent, U.S. Pat. No. 3,681,064 to Shu-Hsiung Yeh, there is disclosed a photoelectrophoretic imaging system in which a thin layer of a suspension of particles in a liquid carrier is interpositioned between two electrodes. Imaging takes place by imposing an electric field across the suspension and exposing same through one of the electrodes. The particles in the suspension may be any suitable photosensitive particle and includes multiple layered particles of photosensitive dyes and/or pigments on a resin core material, similar to those in Kaprelian. Additionally, the electrode spacings may be as low as one mil or less which renders the suspension of particles a thin layer of imaging material.

In German Publication OLS No. 2120384 there is disclosed a photoelectrophoretic imaging system in which imaging particles containing colorants are used for the ultimate purpose of rendering an imaged member functional as a spirit master. The imaging particles contain a colorant in the form of a spirit or alcohol soluble dye, the colorant of the master being transferable to a receiver in the presence of the solvent. The dye photoelectrophoretic imaging particles disclosed include dyed photosensitive pigment particles and dyed resin photosensitive pigment particles. As mentioned above, the dyes are ultimately utilized as a colorant in a photoelectrophoretically prepared master.

SUMMARY OF THE INVENTION

The present imaging system utilizes a composite particle which includes a dye which is to be ultimately imbibed in a substrate and brilliantly amplified subsequent to image formation. More particularly, a color imaging system having proper color separation and ultimately resulting in excellent color image density is demonstrated utilizing a monolayer of dye carrying composite particles. The composites can be freely mixed and coated in a monolayer configuration so as to assure color separation with final high color density heretofore unappreciated in particle imaging. The disadvantages of achieving dye amplification using the difficult-to-fabricate multi-shell liquid dye particles of Kaprelian and Yeh are overcome by the simpler, more efficient composite particles and process of this invention. For example, it is unnecessary to employ the dyed filter layer of Kaprelian, since selective color photosensitivity is inherent in the "driver" materials used in the invention. Further, the dye is in solid form in the composite, and thus the particle does not have to be ruptured to release the amplifying dye; application of thermal energy is sufficient.

An imaging layer is sandwiched between a donor member and a receiver member wherein the layer comprises a monolayer of composite imaging particles, comprised of an imbibable dye and electrically color photosensitive material. In the preferred embodiment, the dye and color photosensitive material are carried by a resin material. By "color photosensitive" is meant that the material is, by itself, inherently electrically sensitive to only a portion of the visible spectrum. The dye material is in solid form, and may be carried on or near the surface of the resin in particulate form, or may be dispersed in particulate form within the resin, or encapsulated thereby, or may be in solid solution with the resin. When under the influence of an electric field, the imaging particles respond to radiation within certain sensitivities by selective adhesion to the receiver member upon sandwich separation whereby each individual composite particle is independently removed from the imaging layer to form a positive image on one of the donor or receiver sheets and a negative image on the other. Either imaged sheet member may be subsequently processed so as to effect dye imbibition or composite particle absorption resulting in a color-amplified image. In the alternative, either image may be transferred to a suitable substrate followed by subsequent dye imbibition. Either monochromatic or polychromatic imaging is within the purview of the instant imaging system.

DETAILED DESCRIPTION OF THE DRAWINGS

Figure 1:
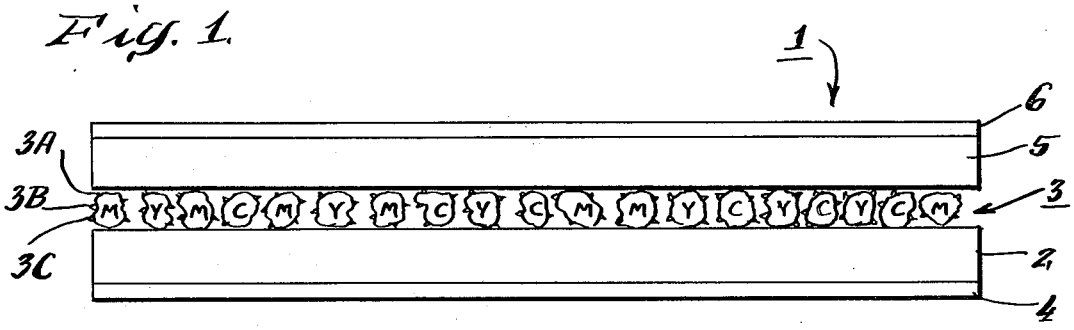
FIG. 1 shows schematically, a side sectional view of a photosensitive imaging member for use in the present invention.

FIG. 1 is a preferred embodiment of the present invention illustrating a monolayer of particles capable of polychromatic imaging. Referring now to FIG. 1 there is demonstrated a color imaging member generally designated 1 which is made up of several components. Donor member 2 has coated on one surface thereof a layer of imaging material comprising a randomly mixed monolayer of a plurality of three different electrically photosensitive composite particles. These composite particles are colored Magenta, Yellow, and Cyan. The different colors for the composite particles in FIG. 1 are indicated by "M" for "Magenta," "Y" for "Yellow" and "C" for "Cyan."

Each electrically photosensitive composite particles 3*a* in layer 3 of FIG. 1 is of a single color and is comprised of solid-form dye 3*b*, shown here as particles on the resin surface, and electrically color photosensitive material 3*c*, e.g., a pigment, carried by the resin material 3*d*. The color photosensitive material is termed the driver material inasmuch as it is this material in which photogeneration takes place during charging and imaging of the particle.

The color photosensitive material is preferably located on the outside of the composite particle so that it is in a position to receive directly a maximum amount of the activating light exposure. However, the material may be attached to the resin material in any manner.

The preferred location of the dye, however, depends to some extent on the mode of dye imbibition. For example, if the entire imaged composite particle is to be thermally absorbed into a suitable substrate, it is not critical where the dye is located in the resin; all of it will be automatically imbibed. Where the dye is to be imbibed without substantial absorption of the particle in the substrate, it would be preferable to have most of the dye located at or near the surface of the resin carrier, as shown in FIGS. 1–3 and 5. However, some dye amplification can always be achieved regardless of the location of the dye and the method of imbibition.

Generally, the composite particles 3*a* average between about 0.5 and 25 microns in diameter. In the preparation of this type of particle (the process to be discussed hereinafter), the composites are milled from a size of above 25 microns to those in the range cited above. A preferred size of the particles is from about 0.5 to 15 microns. It is to be understood that the composite particles may be made up of an agglomerate of smaller discrete composite particles and yet function as a unitary composite particle 3*a* in the imaging monolayer of FIG. 1.

The layer configuration outlined in the drawings represents a random mixture of differently colored electrically photosensitive composites so that uniform color is ultimately achieved. As can be seen from the drawings, the tops and bottoms of the composites are not necessarily coplanar one to another nor are the composites necessarily touching or spaced a preselected distance apart. The imaging layer is, therefore, a monolayer of composites and will be referred to throughout as such; but it is understood, of course, that such terminology means any configuration of composites less than two complete and superimposed layers of composites. This random monolayer insures excellent color separation in the imaging process.

Returning now to FIG. 1, monolayer 3, as mentioned above, comprises differently colored particles: for example, a Magenta composite, a Yellow composite, and a Cyan composite are prepared in separate batches (unimixes), by techniques disclosed herein and then all three unimixes are mixed and uniformly dispersed, e.g. by sonification. Satisfactory dispersing by sonification is provided by any of the standard dispersion equipment models available from the Branson Sonic Power Co. of Danbury, Conn. The uniformly and randomly dispersed composites are then coated onto the donor member 2 at a thickness equal to about the diameter of the composite particles by any suitable coating method well known to those skilled in the art. Typical coating methods include extrusion, air-knife, reverse rod and draw down. As coated, the imaging layer comprises a randomly mixed monolayer as shown in FIG.1.

Referring again to FIG. 1, donor member 2 has a conductive backing 4. This conductive backing is preferred where donor substrate 2 is insulating and may be eliminated where donor member 2 is relatively conductive, such as cellophane. In contact with the upper surface of the imaging monolayer 13 is a receiving member 5. Where receiving sheet 5 is insulating, it will have, as shown in FIG. 1, a conductive backing, layer 6. This conductive backing may be eliminated where layer 5 is conductive. Whether potential is applied or charge imposed, the requirement is to create an electric field across the imaging layer and expose the electrically photosensitive composite particle to electromagnetic radiation which cause the exposed composites to selectively adhere to either of members 2 and 5 upon separation of imaging member 1.

As taught in the prior art, particularly in Luebbe et al., U.S. Pat. No. 3,595,770; Keller et al., U.S. Pat. No. 3,647,659 and Carriera et al., U.S. Pat. No. 3,447,934; such a wide variety of materials and modes for associating and electrical bias therewith are disclosed, e.g., charged insulating webs, may serve as the electrodes, i.e., the means for applying the electric field across the imaging layer, that opposed electrodes generally can be used; and that exposure and electric field applying steps may be sequential. However, as described in Carreira, et al., U.S. Pat. No. 3,616,395 the free surface of the imaging layer may be exposed with an electric field thereacross without the imaging layer being sandwiched between two members at that time.

Figure 2:
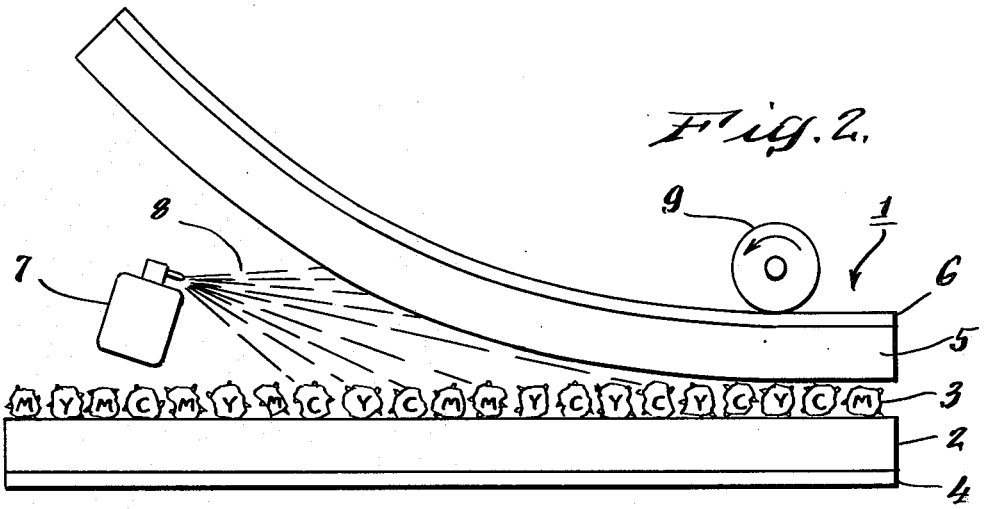
FIG. 2 shows one step in the imaging method of the present invention.

Referring to FIG. 2 of the instantly disclosed process, there is demonstrated one means of activating the imaging layer. As can be seen, the composite particles are covered with an insulating liquid which ultimately enables color separation between the composite particles. After application of the insulating liquid, receiver member 5 is set down on the wet monolayer of particles with the aid of pressure roller 9 to avoid any air gaps in the imaging monolayer. Suitable liquids include all insulating liquids which are not solvents for any of the components of the substrate or composite particles. By insulating, it is meant any such liquid having resistivity above $10^{10}$ ohm-cm or of such resistivity to prevent collapse of the electric field in the imaging layer during the imaging step. Such liquids include aliphatic hydrocarbons, silicone fluids, and fluorinated hydrocarbons. Illustrative of those solvents used in Sohio 3440 odorless solvent, an aliphatic hydrocarbon.

Figure 3:
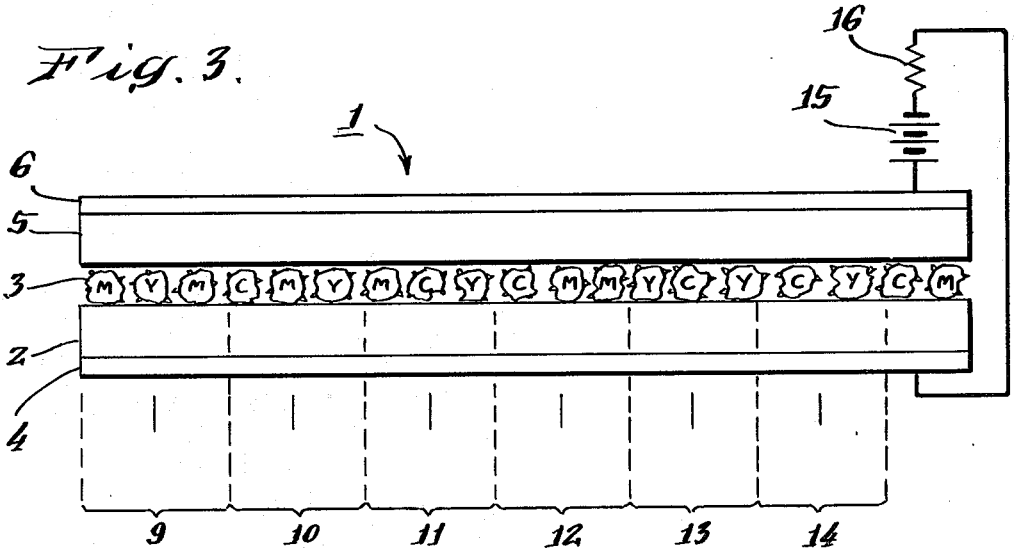
FIG. 3 demonstrates exposure of the imaging member to light of different colors.

To proceed further in producing a full-colored image with an imaging member prepared for imaging in accordance with this invention, with an electric field applied, the imaging layer is then exposed to a full-color original, as by projection, through one of the members 2 (donor) and 4 (receiver). FIG. 3 schematically shows this exposure of the member to different areas of light being projected through donor substrate 2. Area 9 represents the projection of white light, area 10, the projection of no light, area 11, the projection of red light, area 12, the projection of blue light, area 13, the projection of green light, area 14, and the projection of yellow light.

During the exposure of the imaging monolayer 3 to variously colored light, a potential is imposed across imaging material 3 between electrodes formed by conductive layers 4 and 6 by means of potential source 15. The polarity of the potential imposed on the donor member 2 may be either positive or negative with a preferred polarity orientation for some materials. Preferred applied potentials are in the range of about 500 to about 5,000 volts per mil across the imaging member which includes the donor and receiver. Illustratively, where a two-mil Mylar sheet for both donor member 2 and receiver member 5 to be used, the preferred applied voltage is about 2,000 to about 20,000 volts. At least some potential must be imposed before the receiver member 5 is brought into contact with wet imaging monolayer 3. It is desirable that a resistor 16 having a resistance on the order of 1 to 20 megohms be included in the circuit. This resistor prevents air gap breakdown between the imaging monolayer 3 and receiver member 5 as they are brought together or separated.

Figure 4:
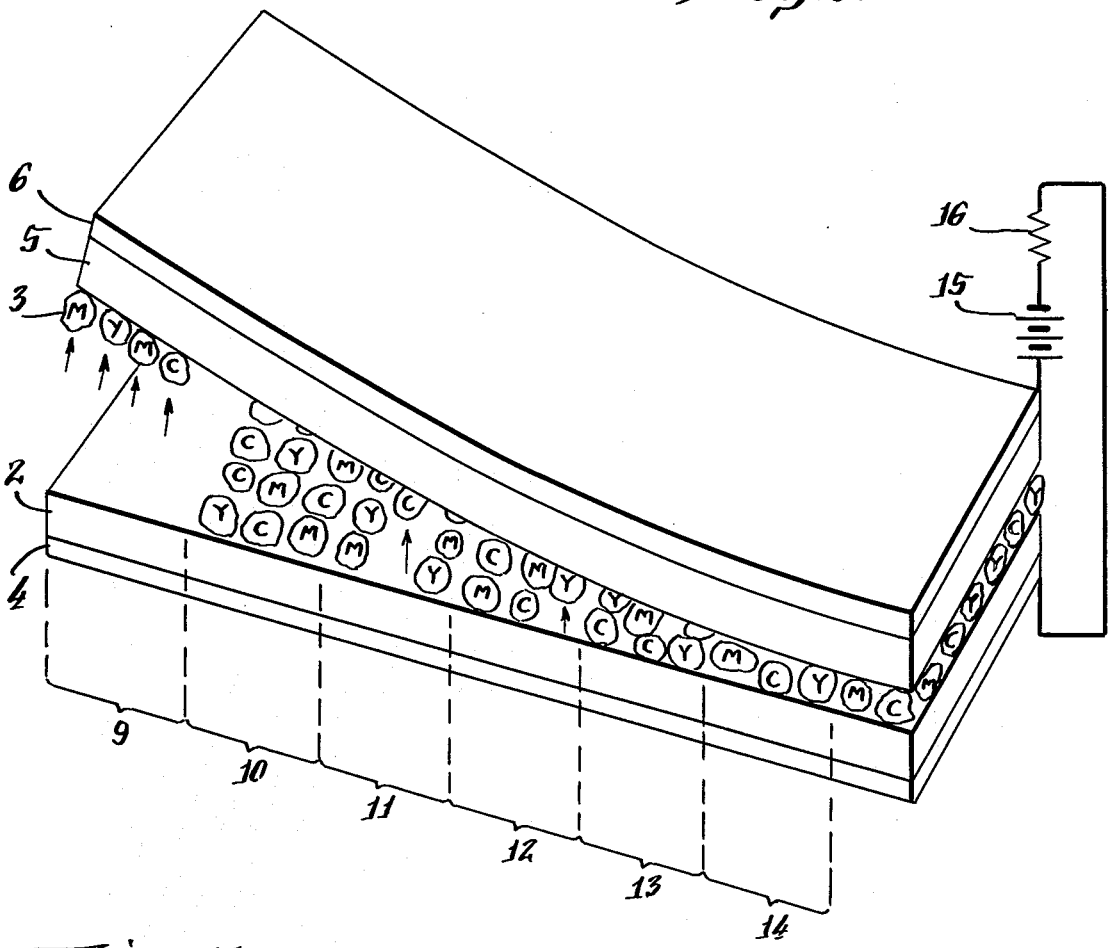
FIG. 4 shows separation of the imaging member to produce a final full-color image.

After exposure, the imaging member 1 is separated as shown in FIG. 4, producing a visible multicolor image. With subtractive color formation, as shown in FIG. 4, the positive color image conforming to the original is ordinarily formed on the donor member 2 while the negative color image is formed on member 5. The applied potential is maintained across the imaging member during the separating step.

As shown in FIG. 4, white light projection in area 9 results in the transfer of the Magenta, Yellow, and Cyan colored individual composites to the receiver member 5, leaving a white or transparent area on donor member 2. Where no light strikes the imaging monolayer, as in area 10, all of the individual composites remain on the donor substrate, combining to form black-appearing area on the donor. Where red light is projected as in area 11, any Cyan material exposed will transfer to receiving sheet 5 upon strip-out leaving behind the Magenta and Yellow areas which combine to appear red to the eye. Where blue light strikes the imaging material, as in area 12, the Yellow material transfers, leaving behind Magenta and Cyan which combine to appear blue to the eye. Where green light strikes the imaging material, as in area 13, the Magenta material transfers leaving behind Yellow and Cyan which combine to appear green to the eye. Where Yellow light strikes the imaging material, as in area 14, the Magenta and Cyan materials transfer leaving behind only Yellow. Integrating this phenomena over the entire surface of the donor, member 2 results in a full-colored reproduction of the color original.

The final steps of the imaging process are the imbibition of the dyes within an imaging substrate or other suitable transfer substrate, and, optionally, the subsequent removal of the photosensitive materials and/or the resin binder material. As pointed out, the process of the present invention contemplates the use of a dye imbibition step to achieve an aesthetically desirable color image. The process of imbibing a dye material into a substrate converts the dye into a molecularly more dispersed form providing a color saturated image. Generally, the imbibition of the dye into the substrate changes the image from a pale color to a brilliant, saturated, more pleasing color. In order to achieve dye imbibition within the purview of the present invention, the dyes are preferably chosen to disperse in the particular image substrate material. The particular dye dispersion, or imbibition, may be accomplished by any suitable means. In the case of a substrate such as Mylar polyester, the dye amplification can be accomplished by heating the positive image on same at about 175° C. from two to five minutes. In the case of other substrate substances, a solvent imbibition may be preferred. The image from either the receiver or donor sheet may be transferred to a further substrate surface in which dye imbibition may take place. For example, imbibition may occur in a suitable resin layer, as for example in a suitably coated paper by heating or by solvent imbibition.

One example of the dye amplification or imbibition step used in the purview of the present invention is as follows: a positive image containing the composites of FIG. 1, i.e., where the dye is particulate and at or near the surface, is created on a Mylar surface utilizing the imaging system outlined in the instant invention. Imbibition of the respective dyes is accomplished by heating the imaged polyester material at 175° C. for three minutes. The residual photosensitive driver material and the resin material are removed from the Mylar image surface by washing with various types of organic solvents such as trichloroethylene, benzene, or acetone. The resultant image within the Mylar, resisting the above solvents in which the dye is ordinarily solvent, is very durable and is brilliantly colored.

To recapitulate the imaging process of the instant invention comprises: (a) providing an imaging monolayer made up of composite particles in an electrically insulating liquid, said composite particles including solid-form dye and color-photosensitive material; (b) applying an electric field across the imaging monolayer; (c) exposing the monolayer to a color image pattern of electromagnetic radiation to which said composite particles are sensitive; (d) separating the photosensitized composites from the unsensitized composites during the application of said field whereby a positive and negative image is formed corresponding to the original image pattern; and (e) imbibing the dyes of an image into a substrate material.

The scope of this invention includes many other materials for each of the components of the imaging member. When conductive backings 4 or 6 are used, they may be rigid or flexible and may comprise any suitable conductive material. Typical conductive materials include: metals such as aluminum, brass, steel, copper, nickel, zinc, etc., metallic coatings on plastic substrates, rubber made conductive by the inclusion of a suitable material therein, or paper made conductive by the inclusion of a suitable material therein or through conditioning in a humid atmosphere to ensure the presence therein of sufficient water content to render the material conductive.

At least one of the donor member 2 or receiver member 5 should be at least partially transparent so that an image may be projected onto the imaging layer therethrough. Preferably, complete transparency is had as for example, by use of Mylar polyester film manufactured by the Dupont Co. of Wilmington, Del. Insulating materials suitable for use in members 2 and 5 are polyethylene terephthalate (Mylar polyester film), cellulose acetate, and the like, optionally backed by conductive electrode material such as evaporated tin oxide.

As mentioned above, the particular dyes used should be imbibable in the sheet material utilized for the ultimate image. If transfer of an image is contemplated, then the dyes used should be capable of imbibition within the transfer sheet material as in the case of gelatin coated paper. Typical conductive transparent materials include cellophane, conductively coated glass, such as tin or indium oxide coated glass, aluminum coated glass or similar coatings on plastic substrates. NESA, a tin oxide coated glass available from Pittsburgh Plate Glass Co., is often used because it is a good conductor, is highly transparent, and is readily available.

The composite imaging particles 3*a* may comprise any suitable electrically photosensitive material which is inherently sensitive to only a portion of the visible spectrum. Satisfactory imaging occurs with composites of up to about 25 microns in diameter, and preferred results occur with diameters of from about 5 to 15 microns. Typical electrically color-photosensitive materials include: Algol Yellow GC, 1, 2, 5, 6-di (C,C'-diphenyl) thiazoleanthraquinone, C.I., No. 67300, available from General Dye Stuffs: Calcium Litho Red the calcium salt of 1-(2-azonaphthalene-1' sulfonic acid)-2-naphthol, C.I. No. 15630 available from Collway Colors; Cyan Blue GTNF, the beta form or copper phthalocyanine, C.I. No. 74160, available from Collway Colors; Diana Blue, 3,3'-methoxy-4,4'-diphenyl-bis (1''azo-hydroxy-3''-naphthanilide, C.I. No. 21180 available from Harmon Colors; Duol Carmine, the calcium salt of 1-(4'-methoxyazobenzene)-2'-sulfonic acid)-2-hydroxy-3-napthoic acid, available from E. I. Dupont de Nemours & Co.; Indofast Brilliant Scarlet Toner 3,4,9,10-bis-N.N' (p-methoxyphenyl)-imidolperylene; C.I. No. 71140, available from Harmon Colors: Indofast Yellow Toner, flavathrone, C.I. No. 70600, available from Harmon Colors; Methyl Violet, a phosphotungstomolybdie salt of 4-(N.N'-trimethylanilino) methylene-N''N''-dimethylanilinium chloride, C.I. No. 42535, available from the Arnold Hoffman Company; Napthol Red B, 1-(2'-methoxy-5'-nitrophenylazo)-2-hydroxy-3''-nitro-3-naphthanilide, C.I. No. 12355, available from Collway Colors; Quindo Magenta RV-6803, a substituted quinacridone, available from Harmon colors, Vulcan Fast Red BBE Toner 35-2201, 3.3'-dimethoxy-4.4'-bi-phenyl-bis (1''-phenyl-3''-methyl-4''-azo-2''-pyrozolin-5''-one), C.I. No. 21200, available from Collway Colors; Watchung Red B, 1-(4'-methyl-5'-chloroazobenzene-2'-sulfonic acid)-2-hydroxy-3-naptholic acid, E. I. Dupont de Nemours & Co.; and pigments such as purified N-2''-pyridyl-8,-13-dioxodinaphtho-(2,1-b; 2',3'-d)-furan-6-carboxamide made as shown in U.S. Pat. No. 3,447,922 and others, prepared as described in U.S. Pat. Nos. 3,448,029; 3,445,277; and in U.S. Pat. No. 3,402,177. Typical photosensitive materials which may have a suitable dye incorporated to produce the desired response in clude 2.5-bis-(p-aminophenyl) 1,3,4-oxadiazol; 4,5-diphenyl- imidazolindine; N-isopropyl carbazole, triphenylamine; triphenyl-pyrol; 1.4-dicyano naphthalene: 1,2,5,6-tetra-azacyclooctatctraene-(2,4,6,8): 2-phenyl-4-alpha-naphthylidencoxazolone; 6-hydroxy-2,3-di(p-methoxy-phenyl) benzofurane; 5-benzylidene-amino-acenaphthene; 3-aminocarbazole and mixtures thereof. Any of the photosensitive materials described above may be sensitized, if desired, with suitable dye sensitizing agents or Lewis acids. Typical Lewis acids include 2,4,7-trinitro-9-fluorenone 2,4,5,7-tetra-nitro-9-fluoreneone; picric acid; 1,3,5-trinitro benzene and chloranil.

A suitable resin material for the instant composites will comprise any type of insulating resin material. Preferable copolymers include polyethylenes such as: Eastman Epolene N-11, Eastman Epolene C-12, available from Eastman Chemical Products, Co.; Polyethylene DYJT, Polyethylene DYLT, Polyethylene DYDT, all available from Union Carbide Corp.; Marlex TR 822, Marlex 1478, available from Phillips Petroleum Co.; Epolene C-13, Epolene C-10, available from Eastman Chemical Products, Co.; Polyethylene AC8, Polyethylene AC612, Polyethylene AC324, available from Allied Chemicals; modified styrenes such as Pliolite (styrene-butadien), available from the Goodyear Corp.; Piccoflex 100 and Piccoflex 150, styrene-indene-acrylonitrile ter-polymers, available from Pennsylvania Industrial Chemical; vinylacetate-ethylene copolymers such as: Elvax Resin 210, Elvax Resin 310, Elvax Resin 420, available from E. I. Dupont de Nemours & Co., Inc.; Vinyl chloride-vinyl acetate copolymers such as: Vinylite VYLF, available from Union Carbide Corp.; styrene-vinyl toluene copolymers; polypropylenes; and mixtures thereof. The use of an electrically insulating binder is preferred because it allows the use of a larger range of electric field strengths. While not to be construed as limiting, the modified styrenes such as those of the Piccoflex series are optimum.

Typical classes of dyes within the purview of the present invention include major chemical types such as azo, including premetallized dyes, anthraquinones, triphenylmethane dyes and others. The other requirement of any dye is that it have the proper color. Of particular utility are those materials which color polyester, polycarbonates, cellulose esters and ethers, and methacrylate resins. Preferred dye materials which are soluble in polyester films include Foron Rabine S-2BFL, available from Sandox Corporation, Dispersol Red B-3B, available from ICI. Eastman Polyester Blue GR, Eastman Polyester Yellow, Eastone Blue GFD, Eastman Blue CWB, all available from the Eastman Kodak Co., and Resolin Red Violet FBL, available from Sandoz Corp.

The electrical potential is shown in FIGS. 3 and 4 as being applied from a potential source 15 having a conductive pathway between conductive backing 6 and conductive backing 4; that is, imaging member 1 is placed between electrodes (conductive backings 4 and 6) having different electrical potential. Alternatively, an electrical charge can be imposed upon one or both of the donor-member and receiving member before or after forming the sandwich by any one of the several known methods for inducing a static electric charge into a material. Static charges can be imposed by contacting the sheet or substrate with an electrically charged electrode. Additionally, one or both sheets may be charged using corona discharge devices such as those described in U.S. Pat. No. 2,588,699 to Carlson, U.S. Pat. No. 2,777,957 to Walkup, U.S. Pat. No. 2,885,556 to Gundlach or by using conductive rollers as described in U.S. Pat. No. 2,980,830 to Tregay et al., or by frictional means as described in U.S. Pat. No. 2,297,691 to Carlson or other suitable apparatus. Imaging occurs when charges are imposed. The maximum limit of applied potential is the breakdown of imaging member 1 such that conductivity of the member 1 is sufficient to prevent imaging. This will vary depending upon the material utilized.

Within the purview of the present invention, a manufacturer may wish to prefabricate a monolayer of composites by stabilizing imaging monolayer 3 so as to render the entire imaging member 1 sufficiently rigid to withstand handling, transportation and storage operations. This can be accomplished by "cementing" the composites within imaging layer 3 to the substrate with a soluble interparticle cement. This is accomplished by including a small amount of resin material which is soluble in the solvent utilized in the coating operation. This enables the particles to adhere to the substrate upon drying. When it is desired to produce a colored image, an insulating liquid, described above, is applied at which time the cement is dissolved thus freeing the particles for imaging.

Suitable cements include Piccotex 75, Piccotex 100 and Piccotex 120 available from the Pennsylvania Industrial Chemical Co., the AROCLOR series of polychlorinated polyphenyls available from Monsanto, and other solid or semisolid resins and polymers soluble in hydrocarbon solvents. Typical materials which are solvents, include kerosene, carbon tetrachloride, petroleum ether, silicone oils, such as dimethylpolysiloxanes, long chain aliphatic hydrocarbons oils such as those ordinarily used as transformer oils, trichloroethylene chlorobenzene, benzene, toluene, xylene hexane, acetone, vegetable oils and mixtures thereof; members of the FREON series of chlorinated, fluorinated hydrocarbons available from E. I. Dupont de Nemours; and, of preference, is Sohio Odorless Solvent 3440, a kerosene fraction available from Standard Oil of Ohio.

Since the subtractive color process depends upon good cyan, magenta, and yellow colors for the materials used in subtractive color imaging, where both the electrically color-photosensitive materials and non-electrically photosensitive dyes are to be used in faithful full-color reproduction of a color original, it is preferred that the photosensitive materials have a natural selective spectral light absorption which is more truly representative of cyan, magenta, and yellow than say red, blue, green, etc. Similarly, it is preferred that the dyes used in faithful full-color reproduction of a color original be representative of the cyan, magenta, and yellow colors. However, it is to be noted in accordance with the invention that the electrically color-photosensitive material is "sacrificial" in the sense that it need not remain on the substrate surface but may be used solely to respond to electromagnetic radiation to which it is sensitive and therefore carry the dye associated with it in the imaging composite to the substrate. Accordingly, the dye need not be the same color as the driver material with which it is associated in situations other than the faithful full-color reproduction of a color original. For example, the driver material of an imaging composite may respond only to red light but have associated with it in the imaging composite an orange or purple colored dye which is ultimately imagewise imbibed in the substrate wherever red appeared in the original. Such combinations are useful in various schemes known to the art as "functional" color schemes. Further, the type of dye to be used is limited only by the environment in which it is used. As long as dye within the imaging composite can survive the environment of the imaging system in which it is used and ultimately reside on the surface of a suitable substrate, any such dye can be used for imaging and ultimate imbibition into any desirable substrate.

While it is not necessary to use charge control agents in the instant system, it is desirable in some cases to assure uniform polarity on all the particles. Any material which effects uniform polarity on the particles may be added to the monolayer to control charge of the composites during imaging. Alternatively, the composites may contain a dye or pigment which itself effectively acts as a charge control agent and therefore no additional material need be added to assure charge control.

Figure 5:
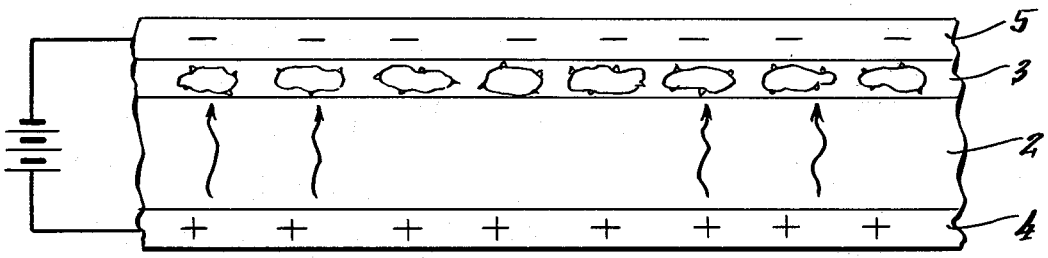
FIG. 5 shows charging and exposure of a specific embodiment of the present invention.

As outlined in FIG. 5, the imaging of a specific embodiment of the present invention is disclosed. Imaging takes place through a transparent NESA Glass electrode 4, and the donor substrate 2 which typically is a layer of Mylar polyester. The light impinges on the composite particles of monolayer 3, said particles having been immersed in an insulating liquid such as Sohio 3340. The impinging radiation causes photogenerating in the photosensitive driver material of the composite particle thereby resulting in a positively charged particle. Upon removing the electrode receiver layer 5 comprised of aluminum, the impinged positively charged particles adhere to the negatively charged aluminum receiver sheet. Because the instantly described preferred embodiment utilizes a substrative color process with exposure through the donor, a negative results on the receiver electrode and a positive on the donor substrate 2. The polyester Mylar donor 2 containing the positive image is thereafter heated whereby imbibition of the dye takes place resulting in a dye intensified image in the donor material. Optionally, the imaged polyester is subsequently washed with trichloroethylene to remove the residual driver material and a resin binder material.

Thus, it is seen that the uses to which color imaging in accordance with the invention may be applied are virtually limitless so long as the following condition is observed: the dye and driver components of the imaging composite should be insoluble in the environment of the imaging system employed, the dye material being soluble and imbibable only into the substrate desired, which substrate may be an element of the imaging member employed.

Although the imaging composites of the invention may be formed by any suitable method, the following five described below have proved satisfactory. These five methods may be conveniently referred to as: the spray-drying method, the mill and heat method, the jet pulverizing method, the melt-blend method, and the precipitation method.

A spray-drying method may conveniently utilize a commercial apparatus such as Laboratory Spray Dryer Model BE-742 (conical type), obtainable from the Bowen Engineering Company, Northbranch, N.J. The dye and resin components of the imaging composite are dissolved in a solvent. Suitable resins include Piccolastic E-100, Piccoflex 120, and Piccoflex 100, and suitable solvents include G.P. grade chloroform, methyl, ethyl ketone, and others. A composite particle of dye in solid solution with the resin is formed by spraying the dispersion through the airbrush and collecting same on the walls of the aluminum cylinder. The driver material component of the imaging composite is then added to the surface of the dye-resin core by suitable steps such as: dispersing a color-photosensitive pigment in the dye-resin solution before spraying, dispersing the spray dried dye-binder particle in a solution of Piccotex 120 and petroleum ether (60–110), dispersing the driver pigment in the solution and spray drying the dispersion. Spray drying may also be used by dispersing both the dye and driver pigment components of the imaging moiety in a binder-solvent solution prior to spray drying. As mentioned above, satisfactory imaging occurs with imaging moieties of up to 25 microns in diameter, the preferred range being from about 5 to 15 microns.

The mill and heat method for producing imaging mode composites, wherein a resin core with driver and particulate dye on the resin surface generally results, comprises ball milling together dye, driver material, and binder particles in a suitable partial solvent for the resin carrier such as Sohio odorless solvent 3440. The resulting paste is then heated to attach the dye and driver material to the tackified or softened binder. Heating times and temperatures may vary, the object being to impart sufficient heat energy to the binder so that the dye and driver materials become bonded to the surface of the binder upon contact. Generally, heating for ten minutes in the range of 150 to 200° C. produced the desired results and may have a tendency to produce rather large imaging moieties, thus yielding a grainy image upon imaging. Heating between the ranges of 85° to 120° C. has produced more satisfactory results with respect to the size of the imaging composite, with heating between 85° to 105° C. being preferred. Generally, because of the difference in relative size between the Magenta, Yellow and Cyan imaging particles for a given binder, the following relative heating temperature and time units yeild particularly good results: Cyan particles from room temperature to 85° C. in ten minutes; Magenta particles at 100° to 105° C. for thirty minutes; and Yellow particles at 100° to 105° C. for five minutes. In the event graininess occurs at the lower temperatures of 85° to 120° C., it is helpful to control the size of the binder particle by chopping or jet pulverizing, or other techniques which result in a narrow size distribution for the binder material component of the imaging composite.

Other modifying steps to the mill and heat method of preparing imaging moieties may be used to control the size distribution of the resulting imaging moieties. Such modifications include the step of subjecting the dispersed dye, driver pigment, and binder components to ultrasonic energies in order to stir and heat these components in the formation of the imaging moiety. One suitable source of ultrasonic energy is the Model S125 Branson Sonifier. Ligroine is a well-known solvent in this modified procedure in that it enhances particle growth within a narrow size distribution.

The precipitation method for forming an imaging composite generally comprises dispersing the pigment and dye components in a suitable liquid by ball milling; heating a milled dispersion of driver in a resin solvent to 90° C. to dissolve Allied Chemical AC-612 polyethylene added in a one to one ratio of polyethylene to the total of pigment and dye; precipitating the polyethylene by adding room temperature isopropyl alcohol at the rate of about 10 cc. per minute while maintaining the temperature of the dispersion at 80° C.; filtering; redispersing the filter cake in the pigment-dye dispersion by milling.

The melt-blend method can be employed to produce composite particles having the dye material dispersed within the resin binder material. Dye material and resin, and optionally, the driver material, are blended uniformly and the blend is heated to beyond the melting point of the resin. The cooled blend is then crushed and wet ball-milled to the desired particle size. Where the blend does not include the driver material, the milled dye-resin core particles are either heat or solvent-tackified in the presence of driver material to bond the latter to the core surface.

It will be understood, of course, that either one or more of the above imaging composite preparation methods may be utilized to prepare imaging particles which may be used in imaging in accordance with the invention.

EXAMPLE 1

A unimix of each of the colors cyan, magenta, and yellow is prepared by the following procedures. A hydrocarbon suspension of color-photosensitive driver, dye and Piccoflex 100 carrier particles are milled with ¼" diameter stainless steel balls for between 16 and 24 hours. Due to their size, yellow driver and cyan driver pigments are premilled before incorporation into their respective unimix suspensions. Each of the cyan, magenta, and yellow unimixes contain the following materials:

| | |
|---|---|
| CYAN | |
| Driver (0.50% wt. to 0.75% wt.) | - premilled beta-phthalocyanine |
| Dye (49.7% wt.) | - purified Eastman Fast Blue BGLF |
| Carrier (49.7% wt.) | - purified Piccoflex 100 |
| MAGENTA | |
| Driver (33.3% wt.) | - purified Naphtol Red B |
| Dye (22.2% wt.) | - Sandoz Foron Rubine S-2BFL |
| Carrier (44.4% wt.) | - purified Piccoflex 100 |
| YELLOW | |
| Driver (33.3% wt.) | - N-2"-pyridyl-8, 13-diodin-aphtho-(2,1-b;2',3'-d)-furan-6-carboxamide |
| Dye (22.2% wt.) | - Eastman Polyester Yellow 6GLSW |
| Carrier (44.4% wt.) | - purified Piccoflex 100 |

After the milling of the suspension, it is then poured into a round bottom flask and heated with stirring to an experimentally determined temperature time condition. These parameters for the respective unimixes are: cyan, 80° C. for one hour; yellow, 90° C. for three hours; and magenta, 110° C. for two hours. After the heating step, the unimixes are then cooled by the addition of an equal volume of room temperature Sohio 3440 solvent which has been previously filtered at room temperature, air dried and stored until use.

EXAMPLE 2

Monochromatic donors containing the randomly dispersed monolayer outlined in the present invention are prepared by coating the suspensions of cyan, magenta or yellow imaging composites prepared according to Example 1 on aluminum foil or Mylar. The coating thickness is controlled by using a Mayer coating rod. The Mayer rod is a solid stainless steel rod which contains a stainless steel wire wound tightly around the rod. The grooves between the wires control the thickness of the photosensitive composite monolayer. The numerical designation of the rod gives the wire diameter in mills. A number 8 Mayer rod is normally used in coating the monolayer on the donors of the instant invention. This rod results in a layer which, after drying at 40° C. for five minutes, is approximately 10 microns thick. Many of the composites are associated into linear structures up to 40 microns in length which structures are broken down by compression into particles which are less than 10 microns. A trimix of each of the cyan, magenta, and yellow composite particles is easily prepared by combining the three unimixes to give the required particle distribution. The trimixes are then applied in the same manner as outlined above for the monochromatic donor and the resulting randomly dispersed monolayer appears as element 3 of FIGS. 1 through 5.

EXAMPLE 3

Generally, imaging of the instantly disclosed randomly dispersed monolayers is carried out in a conventional single set mode utilizing a NESA transparent electrode as shown in element 4 in FIG. 5. The imaging sequence of the precoated and dried imaging monolayer can be outlined as follows: the dried trimix layer prepared above on Mylar of 2 mil thickness is wet with sufficient Sohio 3440 solvent such that in the ultimate sandwich set prepared, as shown in FIG. 5, no air bubbles are present in the imaging layer. An electrical potential of 5000 volts is applied across the sandwich, utilizing the aluminum foil and the NESA conductive film as the two electrodes. The composite particles of the randomly mixed monolayer are then exposed with visible light, the exposures lasting from about 0.5 to 1 second depending upon the light intensity. Exposure takes place through the NESA Glass and Mylar substrate. The exposed sandwich is then separated while the potential is still applied yielding two hydrocarbon wet images: (1) the positive image (composites unexposed to wavelengths to which they are responsive) of the original on the Mylar, and (2) the negative image (composites exposed to wavelengths to which they are responsive) of the original on the aluminum foil.

Subsequently, the Mylar substrate containing the positive image is developed by heating the Mylar to 175° C. for three minutes resulting in dispersion of the dyes into the polyester material. Finally, the dye amplified Mylar image is washed with a solvent to remove both the opaque photosensitive pigment and the diffused Piccoflex 100 resin material. The polyester images which are obtained in this procedure have the dyes dissolved in the Mylar material. Therefore, the images are very durable and the colors are transparent.

EXAMPLE 4

A unimix of each of the colors cyan, magenta, and yellow is prepared by the following procedures. Each of the cyan, magenta, and yellow unimixes contain the following materials:

| | |
|---|---|
| CYAN | |
| Driver | - premilled alpha-phthalocyanine |
| Dye | - purified Eastman Fast Blue BGLF |
| Carrier | - purified Piccoflex 100 |
| MAGENTA | |
| Driver | - purified Naphtol Red B |
| Dye | - Sandoz Foron Rubine S-2BFL |
| Carrier | - purified Piccoflex 100 |
| YELLOW | |
| Driver | - N-2"-pyridyl-8, 13-diodin-aphtho-(2,1-b;2',3'-d)-furan-6-carboxamide |
| Dye | - Eastman Polyester Yellow 6GLSW |

-continued

| | |
|---|---|
| Carrier | - purified Piccoflex 100 |

A hydrocarbon suspension of 18 gram amounts of dye and Piccoflex 100 carrier particles are milled with ½" diameter stainless steel balls for about two hours. Due to their size, yellow driver and cyan driver pigments are premilled before incorporation into their respective unimix suspensions.

The dye-resin dispersion is then filtered and then washed with Sohio 3440 solvent. The filter cake is placed in an oven and melted at 150° C. for 10 minutes. After cooling, the dyed resin is crushed and redispersed into Sohio 3440 to be milled for 10–12 hours, yielding dyed resin particles of 5 micron average size. The latter dispersion is vacuum filtered to a moist cake. Each unimix is then prepared by ultrasonically blending 1.1 gram (half solids—half Sohio 3440) dyed resin paste, 0.1 gram pre-milled driver material, and 10 c.c. ligroine, 90° C. to 120° C. boiling range, clay-column purified. Ultrasonification proceeded at a power level high enough to cause boiling in about one minute.

EXAMPLE 5

A unimix of each of the three colors is prepared by spray-drying as follows. About 25 grams of Piccolastic E-100 resin is dissolved in about 450 milliliters of a saturated solution of the dye in C. P. grade chloroform. The dyes for each unimix are the same as in Example 1. This solution is then spray-dried with a conventional lab-type apparatus using a Binks "Wren" Air Brush Model 59-10001 'A' and a 6.5 inch diameter, 18 inch long aluminum collection cylinder. The spray-dried particles ranged in size from about 5 to 10 microns. These particles were then dispersed in petroleum ether, a non-solvent for the particles, along with about 5 grams of pre-milled alpha phthalocyanine. The dispersion was then spray-dried as above. The spray-dried driver-dyed resin composites were then ultrasonically dispersed in Dow Corning 200 silicone fluid (1 centistoke viscosity) to form the unimixes. Microscopic examination showed no free driver.

The dyes used in the above examples are specifically chosen to dissolve in the Mylar polyester material. Dye amplification or intensification in this case is accomplished by heating the positive image on the Mylar surface at 175° C. from about two to four minutes. This imbibition heating step results in the diffusion of the respective dyes into the polyester material. Visible microscopic examination of cross-sections of the prepared transparencies indicate that the dye materials disperse to a maximum depth of between 10 to 15 microns.

As demonostrated above, the opaque driver photosensitive pigment particles and diffused resin material, Piccoflex 100, are removed from the polyester imaged surface by washing with various types of organic solvents, i.e., trichloroethylene, benzene, and acetone. However, this invention encompasses the alternate method of choosing the resin particle binder and the copy substrate material such that the entire imaging composite particle can be fixed by heat and/or pressure or on the surface of the copy, and the wash-away step eliminated.

It is to be understood that the steps and materials of this invention used can be varied without departing from the spirit of this invention, including materials that exist or may be discoverd that have some or enough of the properties of the particular materials described to be used in their place. For example, the donor and receiver members may be in web form suitable for machine imaging and transfer of the image by mechanical and electrical means to a suitable substrate as, for example, disclosed in co-pending U.S. application Ser. No. 104,340, filed on Jan. 6, 1971; and various treatments given the electrically photosensitive material utilized to vary various properties thereof. Further, the cement referred to above may be applied to the unimixes prior to configuring the imaging member.

It is to be further understood that while the present invention has been described in terms of a three color subtractive process, it is perfectly applicable to monochromatic imaging. Therefore, a monolayer of one of the unimixes described above could be imaged in the same manner as so described for the trimix, the only difference being a final monochromatic image.

Other modifications and ramifications will occur to those skilled in the art upon the reading of the present disclosure. These are intended to be included within the scope of this invention.

What is claimed is:

1. A method of imaging comprising:

(a) providing an imaging monolayer including a mixture of at least two different composite particles with correspondingly different spectral sensitivities in an electrically insulating liquid, said composite particles including a non-photosensitive solid-form dye material and color-photosensitive material, in combination with a resin;

(b) applying an electric field across the imaging monolayer;

(c) exposing the monolayer to an image pattern of electromagnetic radiation to which at least some of said composite particles are sensitive;

(d) separating the photosensitized composites from the unsensitized composites during the application of an electric field whereby a positive and negative image is formed corresponding to the original image pattern; and (e) imbibing the dyes of an image into a substrate material, in order to color-amplify the image.

2. The method of claim 1 wherein during exposure the imaging monolayer of composite particles is sandwiched between donor and receiver members and the image is formed by the separation of the receiver and donor members.

3. The method of claim 1 further comprising the step of removing the residual resin and pigment materials from the dye imbibed substrate by means of a suitable solvent.

4. The method of claim 1 wherein the composite particles have average diameters of up to 25 microns.

5. The method of claim 1 wherein the composite particles have average diameters from 5 to 15 microns.

6. The method of claim 2 wherein the donor member is comprised of a transparent polyester material.

7. The method of claim 2 wherein the receiver member is comprised of conductive material.

8. The method of claim 6 wherein exposure of the monolayer takes place through the polyester film and imbibition of the positively imaged donor is effected by heating the polyester material.

9. The method of claim 1 wherein the monolayer comprises randomly mixed composite particles containing cyan, yellow, and magenta dyes.

10. The method of claim 9 wherein the light absorption spectrum of the dye is substantially the same as the photosensitization spectrum of the associated color-photosensitive material.

11. The method of claim 1 wherein the electric filed is a potential difference of from about 500 volts to about 5,000 volts per mil thickness of the donor member-imaging monolayer-receiver member sandwich.

12. The method of claim 1 wherein at least one of said members is a web.

13. The method of claim 1 wherein the monolayer further comprises a cementing material for the composite particles.

14. The method of claim 1 wherein the insulating liquid has a resistivity of above $10^{10}$ ohm-cm.

15. The method of claim 1 further comprising the additional step of transferring the image from one of the members to a suitable substrate before dye imbibition takes place.

* * * * *